US006619179B2

(12) United States Patent
Mika

(10) Patent No.: US 6,619,179 B2
(45) Date of Patent: Sep. 16, 2003

(54) SMALL FIREARM MUZZLE ACCESSORY MOUNT

(76) Inventor: Josef Mika, 411 Graham Rd., Anderson, SC (US) 29625

( * ) Notice: Subject to any disclaimer, the term of this patent is extended or adjusted under 35 U.S.C. 154(b) by 0 days.

(21) Appl. No.: 10/174,259

(22) Filed: Jun. 18, 2002

(65) Prior Publication Data

US 2003/0019352 A1 Jan. 30, 2003

Related U.S. Application Data

(63) Continuation-in-part of application No. 09/682,158, filed on Jul. 29, 2001.

(51) Int. Cl.[7] ..... F41A 21/32

(52) U.S. Cl. ..... 89/14.05; 89/14.2; 89/14.3; 42/77

(58) Field of Search ..... 89/14.05, 14.2, 89/14.3, 14.4, 16, 30; 42/1.06, 79, 86

(56) References Cited

U.S. PATENT DOCUMENTS

| | | | | | |
|---|---|---|---|---|---|
| 1,171,242 | A | * | 2/1916 | Prather | 89/14.4 |
| 1,354,416 | A | * | 9/1920 | Oliver | 89/14.4 |
| 1,679,048 | A | * | 7/1928 | Miller | 42/79 |
| 3,045,379 | A | * | 7/1962 | Cutts | 42/79 |
| 3,667,570 | A | * | 6/1972 | WerBell, III | 181/223 |
| 4,429,614 | A | * | 2/1984 | Tocco | 89/14.3 |
| 4,510,843 | A | | 4/1985 | Rabatin | 89/14.4 |
| 4,726,280 | A | | 2/1988 | Frye | 89/16 |
| 4,939,977 | A | * | 7/1990 | Stroup | 89/14.4 |
| 5,020,416 | A | | 6/1991 | Tripp | 89/14.3 |
| 5,136,923 | A | | 8/1992 | Walsh, Jr. | 89/14.2 |
| 5,433,133 | A | * | 7/1995 | La France | 89/14.2 |
| 5,559,302 | A | | 9/1996 | Latka | 89/14.05 |
| 5,596,161 | A | | 1/1997 | Sommers | 89/14.2 |

* cited by examiner

*Primary Examiner*—Michael J. Carone
*Assistant Examiner*—Gabriel S. Sukman
(74) *Attorney, Agent, or Firm*—McNair Law Firm, P.A.; Cort Flint

(57) ABSTRACT

An accessory adaptor for a small firearm muzzle is disclosed for attaching a bored firearm accessory in alignment with the firearm bore. The accessory adaptor includes an adaptor body having a full sleeve with internal threads and a partial sleeve with a top opening for receiving a protrusion of the firearm muzzle. A muzzle receiving end of the adaptor body includes a barrel catch. A threaded accessory is threaded into the full sleeve of the adaptor body causing the barrel catch to draw tightly against the barrel protrusion within the top opening and causing a face of the accessory tighten against the muzzle face of the firearm with the bores of the firearm accessory and firearm in alignment.

15 Claims, 4 Drawing Sheets

SMALL FIREARM MUZZLE ACCESSORY MOUNT

This is a continuation-in-part of application Ser. No. 09/682,158 filed on Jul. 29, 2001 entitled Small Firearm Muzzle Accessory Mount, incorporated into this application by reference.

BACKGROUND OF THE INVENTION

The invention relates to the field of firearms, and more particularly to an accessory adaptor for attaching an accessory to the muzzle of a handgun or a rifle, in a quick and easy manner.

The problems associated with the firing of handguns or rifles, such as muzzle jump or felt recoil which affects shooting accuracy, is well known in the handgun art. The recoil is caused when a handgun or rifle is fired, and the reaction force creates a force moment couple tending to twist or rotate the gun causing the muzzle to move upwardly. This occurrence is described in detail in U.S. Pat. Nos. 5,020,416 and 4,429,614. To alleviate this problem, numerous types of accessories have been proposed. Other types of accessories are also well known, such as sound suppressors, flare attachments, grenade launchers, muzzle breaks, etc. The problem of attaching these accessories in a quick and easy manner to the muzzle of the handgun or the rifle so that the accessory bore and muzzle bore are reliably secured and aligned has been a problem. The prior art has proposed numerous means for connecting the accessory to the muzzle of a firearm. There have been generally permanent means for connecting the accessory and muzzle, such as brazing or welding, however these techniques are prone to fracturing upon repeated explosive reactions, and have presented risk of injury to the user and bystanders. Screws and the like are prone to sheer because of the stress incurred after repeated use. Also the necessity to insert screws into the gun barrel itself is undesirable because it is time consuming and can also lead to fracture. It has also been proposed to create a threaded portion within the gun barrel cooperating with a corresponding threaded portion on the accessory. However, handguns or rifles do not typically have threaded portions on the barrels, and the barrel must first be modified to create the threaded portion. U.S. Pat. Nos. 4,726,280 and 5,136,923 disclose accessory devices having threaded portions cooperating with a threaded portion of a gun barrel. Bayonet type connections have also been provided, such as shown in U.S. Pat. No. 5,559,302; and collet type of accessory devices have also been utilized such as shown in U.S. Pat. No. 4,510,843. However, these devices have also not been entirely satisfactory for coupling accessories to handgun or rifle muzzles and, particularly, for allowing attachment of a variety of accessories. U.S. Pat. Nos. 5,433,133 and 5,596,161 disclose coupling members of the quick detach type for attaching an accessory to the front end of a gun barrel. However, these coupling devices require that the muzzle of the gun barrel be machined to provide a special connection to the accessory device.

Thus, it can be seen that the provision of a device or means to attach an accessory to the gun barrel of a handgun or firearm which does not require modification of the handgun, and which allows for attachment of different accessories, is a problem which has not been satisfactorily solved in the prior art.

Accordingly, an object of the present invention is to provide an adaptor for attaching an accessory to the muzzle of a gun barrel, which does not require modification of the gun barrel, and which is easily and quickly attached.

Another object of the present invention is to provide an adaptor for attaching one of several accessories to the muzzle of a gun barrel without modification of the gun barrel.

Another object of the invention is to provide an adaptor for attaching an accessory to the muzzle of a gun barrel which reliably aligns the accessory bore and the gun barrel bore for accurate and safe firing wherein the adaptor quickly and easily attaches the accessory to the gun barrel.

Yet another object of the invention is to provide an adaptor for attaching an accessory to the muzzle of a gun barrel in a matter of a few seconds, facilitating attachment, removal, interchange of accessories generally instantaneously.

SUMMARY OF THE INVENTION

The above objectives are accomplished according to the present invention by providing an accessory adaptor for attaching a threaded accessory to the muzzle of a gun barrel where the gun barrel has a protrusion near the muzzle. The accessory adaptor includes an elongated adapter body having a muzzle end and a barrel receiving end. A full sleeve is formed at the muzzle end of the adaptor body having internal adaptor threads. A partial sleeve is integral with the full sleeve having an interior cylindrical surface for surrounding a portion of the gun barrel. A barrel catch is carried by the receiving end of the adaptor body for engaging the protrusion of the gun barrel when threads of the accessory are threaded into the internal threads of the full sleeve. The adaptor firmly attaches the accessory in alignment to the gun barrel when the accessory threads are tightened into the adaptor threads drawing the barrel catch tightly against the protrusion. Preferably, the interior cylindrical surface is formed between the full sleeve and the receiving end of the adaptor body, and has a curvature corresponding to the curvature of the gun barrel. In one embodiment, the barrel catch includes a raised arcuate ledge raised above the interior cylindrical surface which engages the protrusion of the gun barrel. For example, the protrusion of the gun barrel may include a cylindrical protrusion elevated from the surface of the gun barrel such a band mounting the front sight, and the arcuate ledge engages behind the cylindrical protrusion.

In an advantageous aspect of the invention, the partial sleeve has a top opening formed between the full sleeve and the barrel receiving end of the adaptor body, and the barrel catch projects across a rear portion of the top opening for engaging behind the barrel protrusion when attached. The accessory includes an accessory face abutting the gun muzzle. In one embodiment, the accessory face includes an annular recess and the gun muzzle protrudes into said recess when said accessory is tightly threaded into said full sleeve of the adaptor body. In another embodiment, the gun muzzle includes a muzzle crown into which the accessory face protrudes when said accessory is tightly threaded into the full sleeve of the adaptor body. In both cases, the gun barrel muzzle terminates at the full sleeve of the adaptor so that a generally one-piece, smooth extension is provided in construction and appearance.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
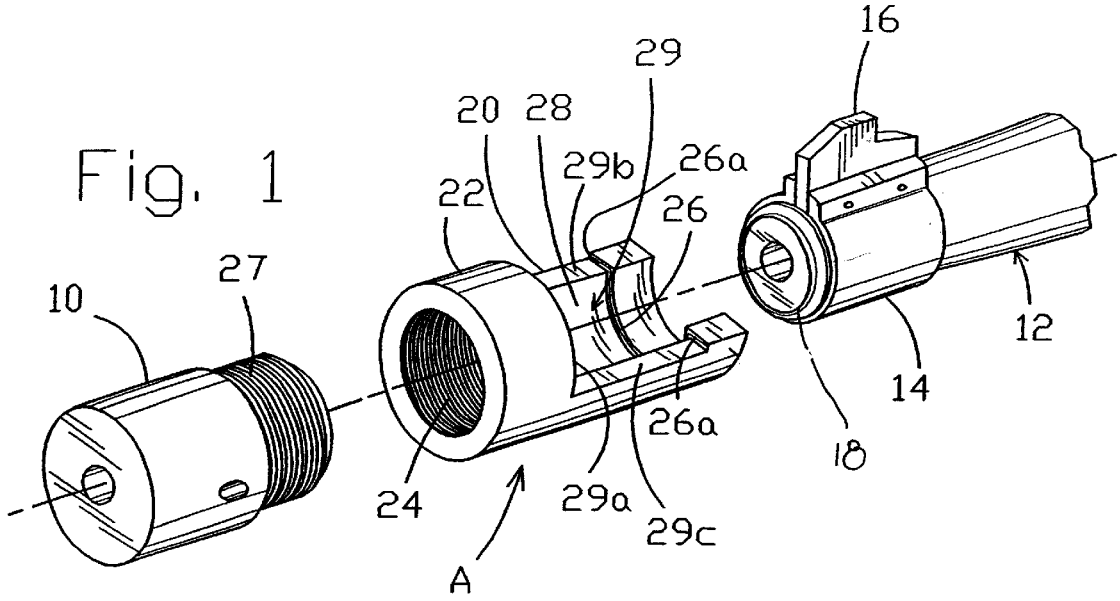
FIG. 1 is a perspective view, with parts separated, showing an adaptor for attaching an accessory to the muzzle of a handgun constructed according to the invention.

Referring now to the drawings, the invention will now be described in more detail.

Figure 2:
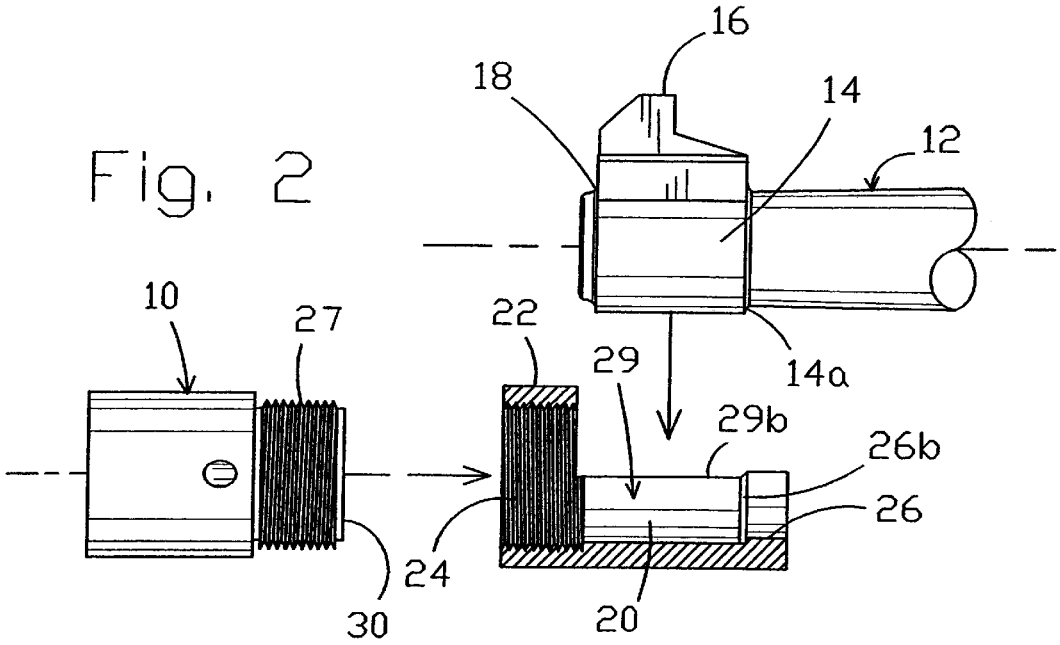
FIG. 2 is a side elevation illustrating an adaptor device, with parts separated, for attaching an accessory to the muzzle end of a gun barrel.

As can best be seen in FIG. 1, an adaptor, designated generally as A, is illustrated for connecting an accessory 10 to a gun barrel 12. In the illustrated embodiment, a protrusion 14 is machined at a muzzle 18 of gun barrel 12 and a front sight 16 is affixed to the protrusion. A muzzle face 18*a* extends slightly past protrusion 14 (FIG. 2). Protrusion 14 may be any elevated protrusion in reference to a surface of gun barrel 12. In the illustrated embodiment, the protrusion is a cylindrical band mounting gun sight 16. A small firearm muzzle accessory 10 may be any one of a number of accessories such as a flash hider, muzzle break, fake or real noise suppressor, flare attachment, grenade launcher, etc.

Figure 3:
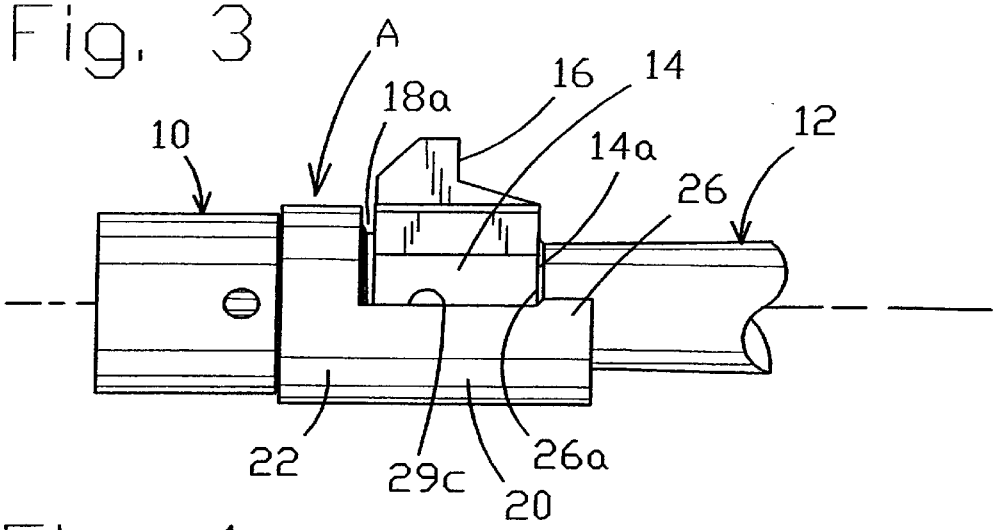
FIG. 3 is a side elevation, with parts attached, of an adaptor for attaching an accessory to the muzzle end of a gun barrel according to the invention.
Figure 4:
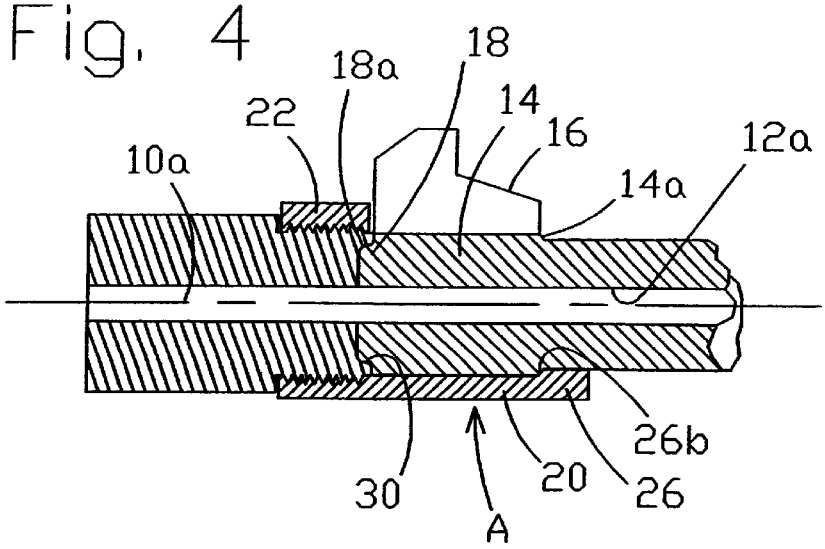
FIG. 4 is a side elevation in cross section illustrating an adaptor for attaching an accessory to the muzzle end of a gun barrel according to the invention.

Referring now in more detail to the illustrated embodiment of FIG. 1, adaptor A includes a body having a partial sleeve 20 and a full sleeve 22. Full sleeve 22 is provided with fine female threads 24 at the muzzle end. Half sleeve 20 includes a barrel catch 26 defined by a raised arcuate ledge 26 having side ledges 26*a,* and an arcuate interior ledge 26*b* elevated above a partial interior cylindrical surface 28 of adaptor body. In use, catch 26 is received behind a protruding rim 14*a* of protrusion 14 with the protrusion occupying cylindrical surface 28 of half sleeve 20 (FIG. 3). Muzzle face 18*a* of gun barrel 12 extends slightly into a recess 30 of accessory 10 at full sleeve 22 of adaptor A (FIG. 4).

As best shown in FIGS. 1 and 2, gun accessory 10 is provided with fine male threads 27 on an attachment end which is threadably received into full sleeve 22 of adaptor A. In this manner, as adaptor A is threaded into full sleeve 20, barrel catch 26 catches gun barrel protrusion 14 and draws the catch and protrusion tightly together. In this tightened configuration, the muzzle face 18*a* and accessory recess 30 are tightly fitted together. Adaptor A is tightly clamped on the gun barrel by the tight fit of accessory threads 27 within full sleeve 22 of adaptor A. Accessory bore 10*a* and firearm bore 12*a* are in axial alignment. Thus, the accessory, adaptor, and gun barrel have a construction and appearance of a relatively smooth gun barrel extension. The gun barrel has a uniform outer diameter except for the cylindrical sight mounting band originally machined in the firearm, and the accessory is adapted without modifying the barrel diameter or threading the interior diameter of the barrel.

The adaptor body includes a top opening 29 defined by a circular wall section 29*a* generally parallel to the muzzle end of said full sleeve 22. The opening is further defined by first and second laterally spaced, parallel edges 29*b,* 29*c*, extending from circular wall section to arcuate ledge 26. The arcuate ledge extends between the parallel edges at the receiving end of the adaptor body.

Figure 5:
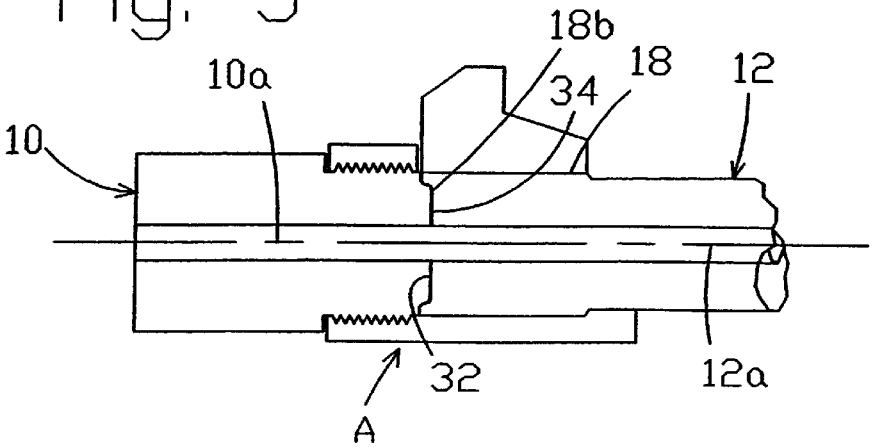
FIG. 5 is a side elevation of an alternate embodiment of an adaptor for attaching an accessory to the muzzle end of a gun barrel according to the invention.
Figure 6:
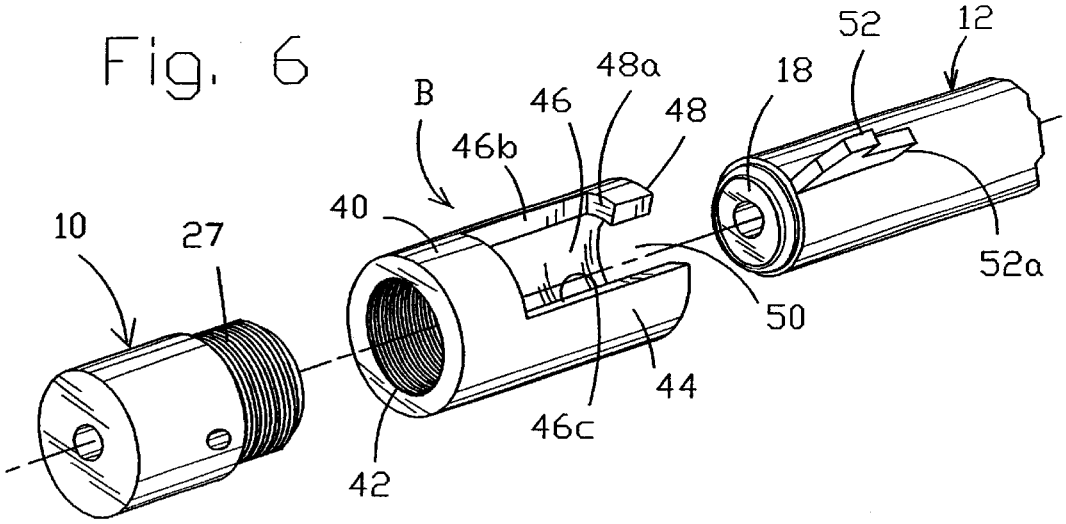
FIG. 6 is a perspective view, with parts separated, of an alternate embodiment of an adaptor for connecting an accessory to the muzzle end of a gun according to the invention.
Figure 7:
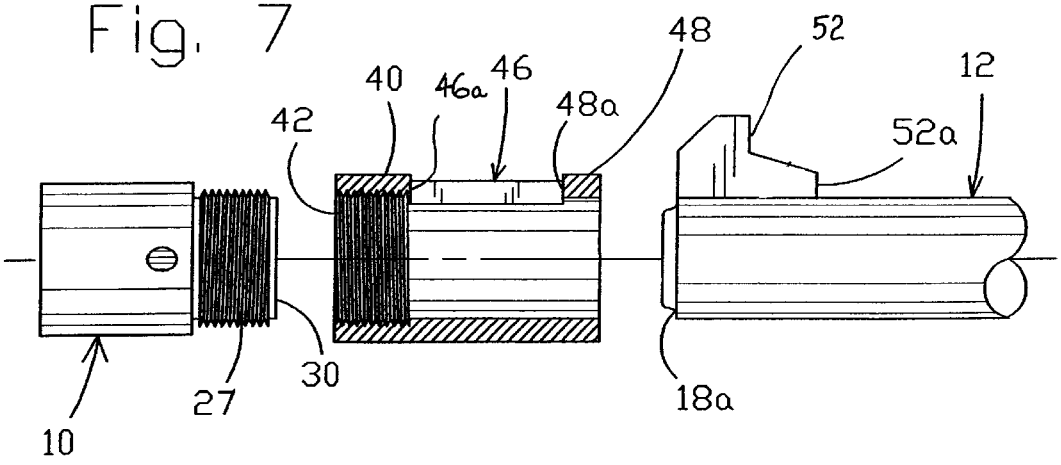
FIG. 7 is a side elevation, with parts separated, of an adaptor for attaching an accessory to the muzzle end of a gun barrel constructed according to the invention.
Figure 8:
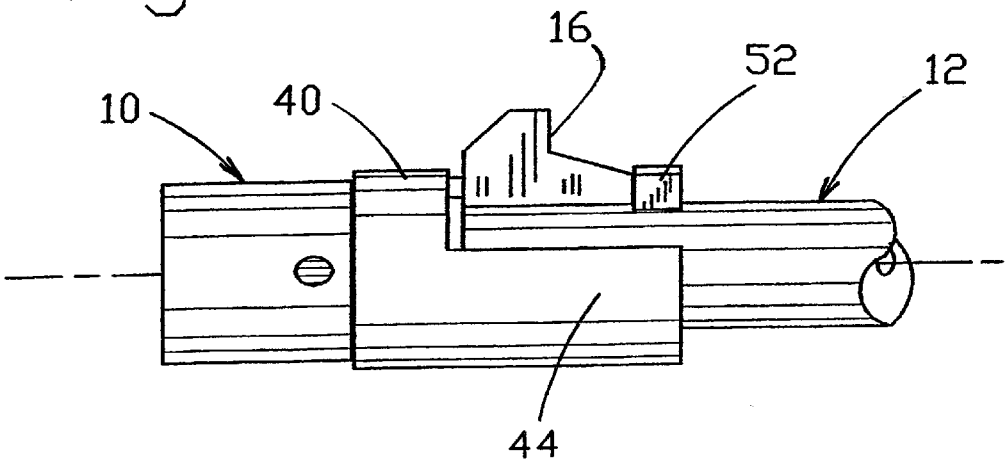
FIG. 8 is a side elevation, with parts attached, of an adaptor for attaching an accessory to the muzzle end of a gun barrel according to the invention.
Figure 9:
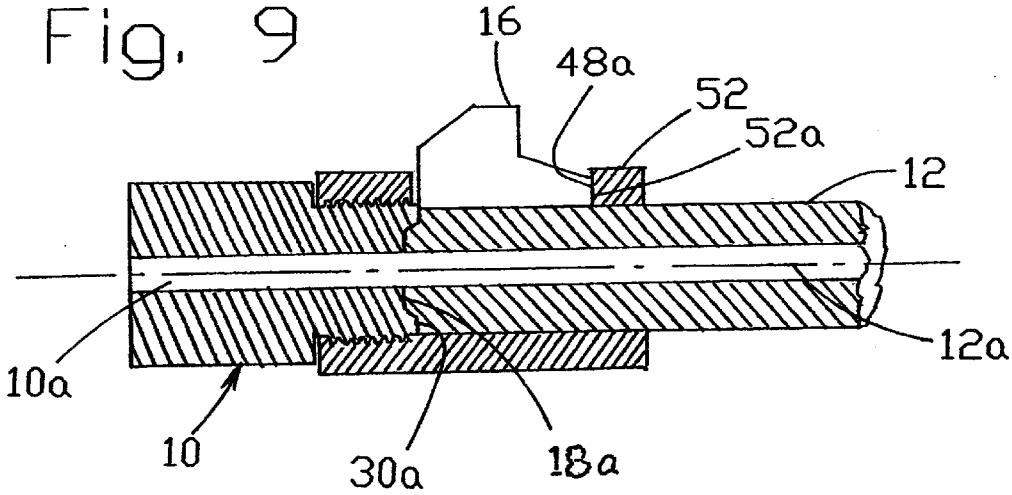
FIG. 9 is a sectional view of an adaptor for attaching an accessory to the muzzle end of a gun barrel constructed according to the invention

FIG. 5 illustrates an alternate embodiment of the illustrated embodiment of FIG. 1 wherein gun barrel 12 includes a crown muzzle 18*b* instead of a protruding muzzle end 18*a*. In this case, accessory 10 is provided with a nose 34 instead of a recess that mates with the recess crown muzzle of handgun or rifle 12. The remaining features of the invention are the same with regard to FIG. 5. As can best be seen in FIGS. 4 and 5, with accessory 10 firmly attached to the muzzle of gun barrel 12, and accessory bore 10*a* and a gun barrel bore 12*a* are accurately aligned with each other for passage of the projectiles. The embodiment of the accessory adaptor described above, is most suited for a handgun or a rifle having a muzzle end having a larger diameter that holds a front sight such as on a Ruger Mark II pistol or a Ruger® 10/22 self loading carbine. An accessory can be attached in about 5 seconds.

While drastic modifications of the gun barrel and barrel threading are to be avoided, the invention may have application to firearms where slight modifications are made. For example, the barrel muzzle protrusion may be provided by protruding screws attached to the end of the muzzle, without altering the uniform diameter. Likewise, a groove can be machined into the gun barrel, or counter-bored blind holes may be machined into the barrel, at the muzzle perpendicularly to the access to the bore, for engagement of the barrel catch of the adaptor. A groove may be provided by one or two circumferential groves machined into the barrel at the muzzle perpendicularly to the bore on the outside of the barrel end with machine depth equal approximately one-third of the machine diameter. In this manner, a barrel catch of adaptor A may be received in the machined bores, or a catch provided to engage behind protruding screws attached to the end of the muzzle. These variations require only minor modifications to the gun barrel.

Referring to FIGS. 6–9, an alternate embodiment of an accessory adaptor will now be described. The illustrated embodiment of FIG. 6, an adaptor B is illustrated having a full sleeve 40 provided with fine female threads 42. The remainder of adaptor B preferably includes a partial sleeve 44 defined by a top opening 46 machined into the adaptor. A barrel catch 48 projects partially into opening 46 to define an entrance slot 50. Top opening 46 is defined by a circular wall section 46*a* generally parallel to full sleeve 40, a first edge 46*b* extending from the circular wall section to barrel catch 48, a second edge 46*c* extending from the circular wall section to a free end of the adaptor body where entrance slot 50 is formed between the second edge and the barrel catch. The barrel protrusion is received through the entrance slot for attachment to the adaptor. In this embodiment, slot 50 receives a front sight 52 mounted to the muzzle 18 of gun barrel 12 as the protrusion. In this case, there is no cylindrical protrusion formed on gun barrel 12. In use, adaptor B is placed on gun barrel 12 with front sight 12 being received through slot 50. Adaptor B is then turned so that catch 48 catches on to the back end 52*a* of front sight 52. For this purpose, catch 48 may be provided with a vertical abutment face 48*a* abutting rear surface 52*a* of front sight 52 when accessory 10 is threaded into full sleeve 40. In this manner, adaptor B firmly attaches accessory 10 to the muzzle of barrel 12 when accessory face 30 is threaded into abutment with muzzle end 18*a*. Tightening of accessory 10 causes rear catch 52 to tighten behind front sight 16 until a full reliable attachment is provided. In this manner, barrel bore 12*a* and accessory bore 10*a* are in accurate alignment for passage of the ammunition. The embodiment of FIGS. 6–9 is illustrated with a Ruger® Mark II target pistol. This embodiment of the invention attaches an accessory to the gun muzzle in about 2 seconds.

Thus, it can be seen that an advantageous construction can be had in accordance with the invention for a adaptor for attaching an accessory to the muzzle of a firearm where little or no modification is required of the gun barrel and the accessory may be reliably attached in the matter of a few seconds.

While a preferred embodiment of the invention has been described using specific terms, such description is for illustrative purposes only, and it is to be understood that changes and variations may be made without departing from the spirit or scope of the following claims.

What is claimed is:

1. An accessory adaptor for attaching a threaded accessory to the muzzle of a gun barrel where the gun barrel has a protrusion near the muzzle of the barrel, wherein said accessory adaptor comprises:

an elongated adapter body having a muzzle end and a barrel receiving end;

a full sleeve formed at a muzzle end of said adaptor body having a continuous cylindrical body with internal adaptor threads;

a partial sleeve integral with said full sleeve having a partial cylindrical body with an interior cylindrical surface for surrounding a portion of an outer diameter of said gun barrel;

said partial cylindrical body including opposed parallel side edges defining a cylindrical body of no more than a half cylinder and a continuous top opening between said opposing side edges for radially receiving said outer diameter of said gun barrel;

a barrel catch carried by said receiving end of said partial cylindrical body for engaging said protrusion of said gun barrel when radially received over said gun barrel and the threads of the accessory are threaded into said internal threads of said full sleeve;

whereby said adaptor is placed partially around said muzzle end of said gun barrel from a radial direction and firmly attaches said accessory in alignment to said gun barrel when said accessory threads are tightened into said adaptor threads drawing said barrel catch and said protrusion tightly together with said accessory abutting the gun muzzle.

2. The device of claim 1 wherein said interior cylindrical surface is formed between said full sleeve and said barrel catch of said adaptor body, and conforms to the outer diameter of said gun barrel.

3. The device of claim 2 wherein said barrel catch includes a raised arcuate ledge raised above said interior cylindrical surface which engages said protrusion of said gun barrel.

4. The device of claim 3 wherein the protrusion of the gun barrel includes a generally continuous cylindrical protrusion formed around said gun barrel at said muzzle, said cylindrical protrusion being elevated from the surface of said gun barrel, and said arcuate ledge engages behind said continuous cylindrical protrusion with said interior cylindrical surface cradling said gun barrel and protrusion when said adaptor is attached.

5. The device of claim 3 wherein said top opening is defined by a circular wall section of said full sleeve generally parallel to and spaced from said muzzle end of said full sleeve, first and second laterally spaced edges parallel to one another extending from said circular wall section to said arcuate ledge of said partial cylindrical body to define a width of said top opening; and said arcuate ledge extending between said parallel edges at said receiving end of said partial cylindrical body.

6. The device of claim 1 wherein said barrel catch includes a continuous raised arcuate ledge projecting across a rear portion of said top opening for engaging behind said generally continuous cylindrical barrel protrusion when attached to said gun muzzle.

7. The device of claim 1 wherein said gun barrel has a uniform outer diameter along the length thereof terminating at said muzzle.

8. The device of claim 1 wherein the gun barrel has a uniform outer diameter along its length and said gun barrel protrusion includes a cylindrical band surrounding said gun barrel with a front gun sight carried by said cylindrical band, and said top opening of said partial cylindrical body having a sufficient width so that said cylindrical band may be radially received through said top opening into said partial cylindrical body.

9. The device of claim 8 wherein said barrel catch includes an arcuate ledge elevated above said interior arcuate surface of said adaptor body adjacent said barrel receiving end for engaging said cylindrical band.

10. A small firearm having a gun barrel with a gun sight and a muzzle comprising:

a raised annular protrusion carried by said gun barrel adjacent said muzzle along with said gun sight;

said annular protrusion and gun sight providing a generally continuous annular band around said muzzle;

an adaptor engaging said annular band carried by said gun barrel;

said adaptor including an adaptor body having a full sleeve with internal threads;

a partial sleeve formed between said full sleeve and a free end of said adaptor body surrounding a portion of said gun barrel;

a barrel catch formed on a rear portion of said partial sleeve engaging behind said annular band on said gun barrel; and an accessory having a muzzle end and an opposing end with external threads threaded into said internal threads of said full sleeve of said adaptor body causing said accessory to be firmly attached to said gun barrel by means of said annular band and barrel catch being tightly drawn together when said accessory is threaded into said full sleeve.

11. The device of claim 10 where said gun barrel and said muzzle have a uniform outer diameter.

12. The device of claim 11 wherein said accessory includes an accessory face abutting said gun muzzle in an area adjacent said full sleeve of said adaptor body.

13. The device of claim 12 wherein said accessory face includes an annular recess and said gun muzzle protrudes into said recess when said accessory is tightly threaded into said full sleeve of said adaptor body.

14. The device of claim 10 wherein said gun muzzle includes a muzzle crown into which said accessory face protrudes when said accessory is tightly threaded into said full sleeve of said adaptor body.

15. The device of claim 10 wherein said barrel catch includes a raised arcuate ledge raised above said interior cylindrical surface of said partial sleeve of said adaptor engaging said annular band.

* * * * *